US005358461A

United States Patent [19]

Bailey, Jr.

[11] Patent Number: 5,358,461

[45] Date of Patent: Oct. 25, 1994

[54] EXERCISER ACTIVATED BODY-MOUNTED LIGHTS AND GENERATORS

[76] Inventor: Russell M. Bailey, Jr., R.F.D 2 Box 495-2, Claremont, N.H. 03743

[21] Appl. No.: 107,234

[22] Filed: Aug. 16, 1993

[51] Int. Cl.[5] ..... A63B 71/00

[52] U.S. Cl. ..... 482/2; 482/124; 482/903; 362/103; 290/1 R

[58] Field of Search ..... 482/1-3, 482/14, 44, 92-94, 104, 106, 108, 121, 124, 903; 2/69, 102; 362/103, 108; 290/1 R, 1 D; 310/80, 75 B; 322/42

[56] References Cited

U.S. PATENT DOCUMENTS

| | | | |
|---|---|---|---|
| 391,224 | 10/1888 | Blair | 310/75 B X |
| 444,881 | 1/1891 | Gardiner | 310/75 B X |
| 638,232 | 12/1899 | Fortier | 482/2 X |
| 3,589,193 | 6/1971 | Thornion | 482/2 |
| 4,482,151 | 11/1984 | Zwilling | 482/108 X |
| 4,512,566 | 4/1985 | Bicocchi | 482/2 |
| 4,794,496 | 12/1988 | Lanes et al. | 362/103 X |
| 4,805,901 | 2/1989 | Kulick | 482/2 X |
| 4,961,573 | 10/1990 | Wehrell | 482/124 X |
| 5,070,436 | 12/1991 | Alexander et al. | 362/103 X |
| 5,071,117 | 12/1991 | Mautner et al. | 482/57 |
| 5,087,033 | 2/1992 | Tagney et al. | 482/54 |

*Primary Examiner*—Richard J. Apley
*Assistant Examiner*—Joe H. Cheng
*Attorney, Agent, or Firm*—Donald W. Meeker

[57] ABSTRACT

Generators attached to bright lights on exercise clothing are turned by recoiling pull-cords attached to hand grips pulled during the normal arm movement of the exercise to light the path of the exerciser. Bright white front lights may pivot to adjust for the body angle of the exerciser. Colored back lights may also be lighted to make the exerciser more visible from the rear. A vest or belt and shoulder straps both attached adjustably by VELCRO (hooks and loops fastener) are used to support the generators and lights on the body of the exerciser. Wires run under the material of the belt or vest to the lights. Alternately, a single generator in the center of the back with two separate cord reels, on at each side, may be used to turn the generator. The generators and reels are covered by water-proof material. A one-way drive in the cord reel turns the generator only in one direction to create power. Weights may be added to the hand grips to enhance the exercise effect of moving the arms. An alternate grip in the shape of a ski-pole grip is attached to a ski pole for cross-country skiing at night. The system could be supplemented with a battery to store electricity so that the lights may remain on during rest periods. The invention is used for night-time jogging, walking, rollerblading, cross-country skiing, or other activities where it is desired to light the path of the exerciser and make the exerciser visible from the rear.

15 Claims, 1 Drawing Sheet

EXERCISER ACTIVATED BODY-MOUNTED LIGHTS AND GENERATORS

BACKGROUND OF THE INVENTION

1. Technical Field

The present invention relates to illuminating devices worn on the body and in particular to pathfinding and safety lights worn on the body of an exerciser with generators activated by the movements of the exerciser.

2. Description of the Prior Art

Night-time jogging, walking, rollerblading, cross-country skiing, or other activities poses two primary problems: seeing and being seen. Injuries are a risk because of poor visibility in the dark. Exercisers traveling at a relatively high speed at night can trip over things or run into things in the exercise's path. When exercising on roadways, there is an additional danger of being struck by a vehicle because the exerciser is not visible to the vehicle driver. There are many garments with reflective surfaces and some with safety lights allowing others, especially motorists, to see them and avoid hitting them.

A few devices have been developed for lighting the path of an exerciser including lanterns on hats and on belts and vests. However, because of the relatively high power requirement for bright lights to illuminate the path of an exerciser, large batteries are required interfering with the performance of the athlete. If small batteries are used, the bright pathfinding lights would quickly drain the batteries leaving the exerciser in the dark.

DISCLOSURE OF INVENTION

In the present invention, providing one or two generators, turned by recoiling pull-cords attached to hand grips, the exerciser pulls on the cords with the normal arm movement involved in the exercise to generate sufficient power for a relatively bright (white) front light or lights to light the path of the exerciser and red rear lights to insure that the exerciser may be seen by vehicles approaching from the rear. By using one or two generators, bright lights for lighting the path can be used and stay lighted all of the time that someone is exercising. Tilting front lights allow the exerciser to adjust the vertical angle of the lights to adjust for body angle depending on the type of exercise and the intensity of the exercise to light the path well at any body angle. An auxiliary small battery charged by the generator may be used to provide light during times that the exerciser might rest.

The generator and lights are mounted on straps and a body belt or on a vest or other clothing articles to be donned easily before going out to exercise in the dark. Wires are underneath the belts or material of the vest or other clothing so that the wires do not get in the way of the activity or present an unsightly appearance. The generators and reels are covered by a water-proof covering and all of the lights have water-proof casings to avoid any shorting out problem in case the exerciser encounters rain.

A V-shaped cable connection between a pull cable and the top end and bottom end of the hand grip allows a natural smooth arm movement during exercise with an even resistance from the reel on both the top and bottom of the hand grip. Additional weights can be inserted as desired inside the hand grips to provide more exercise for the arm to increase strength or stamina. For cross-country skiing, a ski-pole type hand grip is used with a ski pole fitted within the hand grip with a tight friction fit and the V-shaped connection to the pull cable extending from a top and bottom of the hand grip for a smooth even pull against the reel resistance allowing a natural poling motion.

BRIEF DESCRIPTION OF THE DRAWINGS

These and other details and advantages of my invention will be described in connection with the accompanying drawings, which are furnished only by way of illustration and not in limitation of the invention, and in which drawings.

BEST MODE FOR CARRYING OUT THE INVENTION

Figure 1:
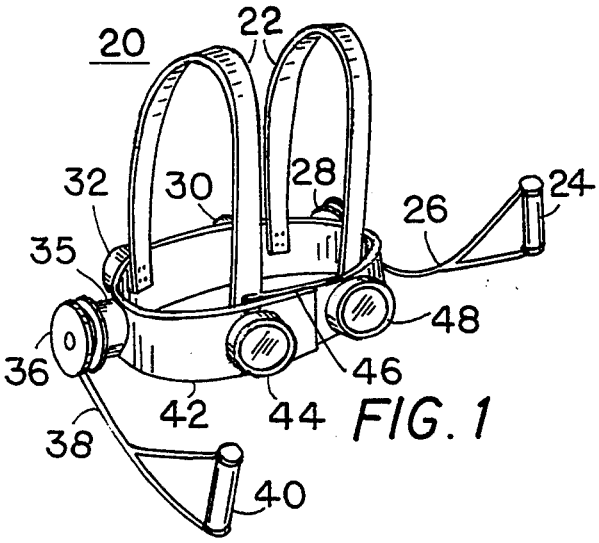
FIG. 1 is a perspective view of the preferred embodiment of the invention with the lights and generators mounted on a belt with shoulder straps, not showing the water-proof covering over the generators and reels.
Figure 2:
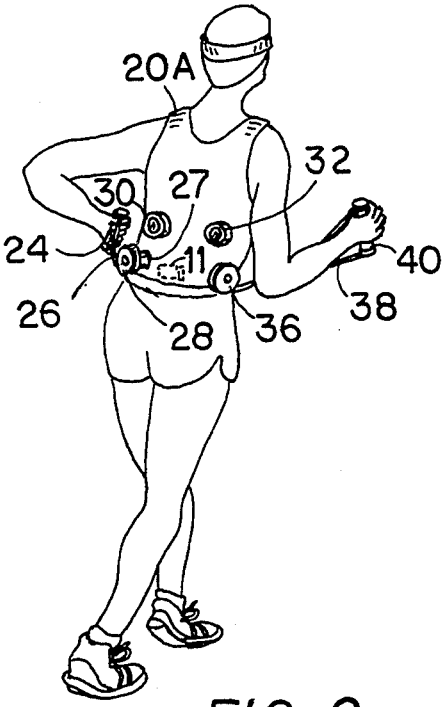
FIG. 2 is a perspective view of a jogger wearing a vest bearing the lights and generators, not showing the water-proof covering over the generators and reels.
Figure 7:
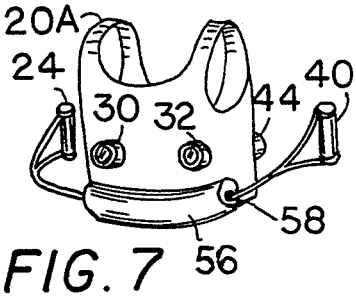
FIG. 7 is a perspective view of the vest showing the water-proof covering over the generators and reels on the back of the vest.

In FIGS. 1, 2 and 7, exerciser activated body-mounted lights and generators comprise a clothing accessory (such as a belt and shoulder strap harness 20 in FIG. 1, or a vest 20A in FIGS. 2 and 7) worn during exercise. VELCRO (hooks and loops fastener) fasteners 46 adjustably secure the clothing accessories to the exerciser. Mounted on the front of the clothing accessory, at least one bright light and preferably a pair of bright white lights 44 and 48 illuminate a path of travel of the exerciser. Mounted on the back of the clothing accessory, is at least one colored light, and preferably two red lights 30 and 32 make the exerciser clearly visible from the back. Mounted on a back of the clothing accessory adjacent to a side, is at least one generator and preferably a pair of generators 27 and 35 to power the lights. Rotatably connected to each generator by a one-way clutch, a spring-loaded self-returning reel 28 and 26 having a pull cord 26 and 38 respectively, wound around each reel. A hand grip 24 and 40 is attached to an outer end of each cord 26 and 28 grasped by the exerciser for pulling during the normal arm movement of the exercise. Each hand grip 24 and 40 is connected to its respective pull cable 26 and 38 by a V-shaped connector so that equal resistance is experienced at the top and bottom of each hand grip to permit smooth natural arm movements during exercise.

Figure 3:
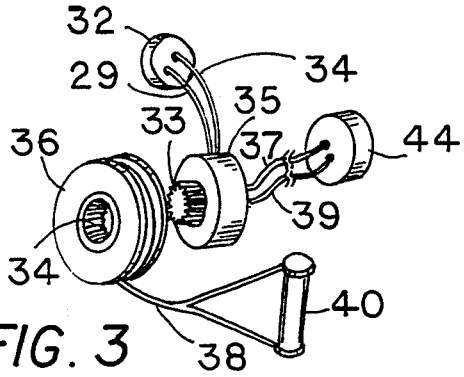
FIG. 3 is a perspective view of a generator, light, pull cord, and turning wheel aligned for assembly.

In FIG. 3 in response to the pull cord 38 the turning element of the reel 36 has internal gear teeth 34 which engage a gear 33 on the generator 35. From the generator 35 wires 29 and 31 lead to light 32 and wires 37 and 39 lead to light 44 under the clothing accessory to power the lights.

Figure 4:
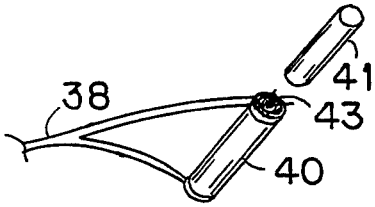
FIG. 4 is a partial perspective view showing the hand grip on the pull cord with a weight aligned to be inserted in the hand grip.

In FIG. 4 the hand grip 40 is a hollow shaft with a central opening 43 and weighted cylinders 41 are removably inserted in the top of the hand grip for additional strength and endurance conditioning during the exercising. The weights may be friction fit or caps may secure them within the hand grips.

In FIG . 5 an alternate embodiment of the invention uses a single generator 50 mounted in the center of the back of the clothing accessory (the belt 42A of which is shown). Rotatably connected to the generator by long rotatable rods encased in tubes 47 and 49, a pair of spring-loaded self-returning reels 28A and 36A use one-way clutches to turn the generator in response to the pull cords 26 and 38 wound around the reels 28A and 36A positioned adjacent to the sides of the clothing accessories. The single generator 50, larger than the small pair of generators, provides power to all the lights.

Figure 6:
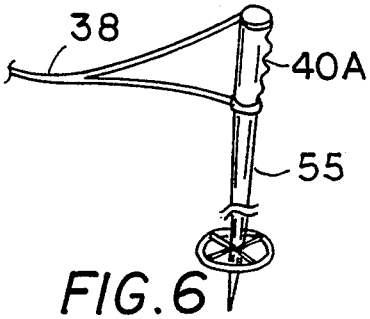
FIG. 6 is a partial perspective view of an alternate embodiment of a hand grip with a ski pole inserted in the grip.

In FIG. 6 an alternate embodiment of the hand grip 40A has a hollow shaft with a bottom opening to friction fit a ski pole 55 within the hand grip.

Figure 5:
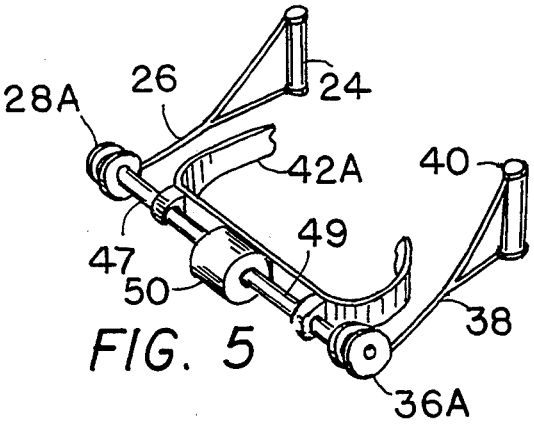
FIG. 5 is a simplified partial perspective view showing an alternate embodiment with a single generator and two pull-cord reels, not showing the lights, and water-proof covering for the generator and reels.

In FIG. 7 the vest 20A is shown with a water-proof covering 56 over the generators and reels. The coverings are not shown in FIGS. 1, 2, and 5 to enable the viewing of the components, but they would all use water-proof coverings to prevent shorting of the electrical components should the exerciser encounter rain. The cable is pulled through an opening 58 in the covering.

Figure 8:
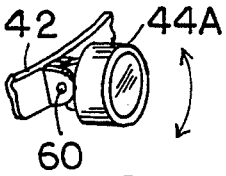
FIG. 8 is a partial perspective view of an alternate embodiment of a bright white front light mounted on a pivot.

In FIG. 8 an alternate embodiment of a front bright white light 44A is mounted to the clothing accessory 42 by a swivel joint 60 to allow the light to pivot vertically (arrows) to adjust the angle of light according to the body angle of the exerciser.

An optional supplementary battery 11 (shown dashed in FIG. 2) powered by the generator may be used to supply power to the lights during rest periods.

As seen in FIG. 2 the exerciser grasping the hand grips 24 and 40 automatically pulls on the pull cords 26 and 38 during the course of exercising. In jogging, walking, rollerblading, skating, crosscountry skiing, and many other athletic activities this natural swinging arm movement occurs and can be put to use generating power for lights at night. The power from the generators 27 and 35 turned by the reels 28 and 36 is sufficient to light bright white lights 44 and 48 in front for illuminating the path of the exerciser, as well as red lights 30 and 32 in the rear to enable motorists to see the exerciser clearly. The lights and generators are shown mounted on a harness in FIG. 1 and a vest in FIG. 2, but it is understood that they may be mounted on anything worn by exercisers.

It is understood that the preceding description is given merely by way of illustration and not in limitation of the invention and that various modifications may be made thereto without departing from the spirit of the invention.

I claim:

1. An apparatus having body-mounted lights and generators activated by an exerciser during exercise, comprising:

a clothing accessory worn by an exerciser during exercise having a front oriented in a direction of travel of an exerciser, a back oriented in a direction opposite the direction of travel and two sides in-between the front and the back;

light means having at least one bright light mounted on the front of the clothing accessory for illuminating a path of travel of the exerciser;

generator means having at least one generator mounted on the back of the clothing accessory to power the light means, and a water-proof covering covers the generator means;

at least one spring-loaded self-returning reel rotatably connected to the generator means by a one-way clutch;

a pull cord wound around the spring-loaded self-returning reel;

a handgrip connected to an end of the pull cord and is grasped by the exerciser for pulling during the normal arm movement of the exercise; and wires connect the generator means under the clothing accessory and the light means for providing power to the light means.

2. The apparatus of claim 1, wherein the light means further comprises at least one colored light mounted on the back of the clothing accessory for making the exercise clearly visible from the back.

3. The apparatus of claim 2, wherein the at least one bright light is a pair of bright white lights mounted on the front of the clothing accessory.

4. The apparatus of claim 3, wherein the pair of bright white lights are mounted on swivel joints to allow the pair of bright white light to pivot up and down.

5. The apparatus of claim 3, wherein the at least one colored light is a pair of red lights mounted on the back of the clothing accessory.

6. The apparatus of claim 5, wherein the at least one generator is a pair of generators mounted on the back of the clothing accessory, and each generator having a spring-loaded self-returning reel rotatably connected by a one-way clutch with a pull cord and a handgrip connected thereto, wherein each generator is located adjacent to a side of the clothing accessory, and each generator powers a bright white light and a red light.

7. The apparatus of claim 5, wherein the at least one generator is a single generator mounted on the center of the back of the clothing accessory, and wherein the apparatus further comprises two long rotatable rods, each one of the rods having an end rotatably connected to the single generator and the other end of each rod rotatably connected to a spring-loaded self-returning reel by a one-way clutch, a pull cord wound around the spring-loaded self-returning reel, and a handgrip connected to an end of the pull cord, wherein the spring-loaded self-returning reels are positioned adjacent to the sides of the clothing accessory, and the single generator powers both bright white lights and both red lights.

8. The apparatus of claim 5, wherein the clothing accessory further comprises a belt and shoulder straps, and a portion of the belt covers the generator means.

9. The apparatus of claim 8, wherein the belt is adjustably with hooks and loops fasteners.

10. The apparatus of claim 5, wherein the clothing accessory is a vest and a portion of the vest covers the generator means.

11. The apparatus of claim 10, wherein the vest is adjustably with hooks and loops fasteners.

12. The apparatus of claim 5, wherein the handgrip is connected to the pull cord by a V-shaped cable connection which attaches to a top end and a bottom end of the handgrip.

13. The apparatus of claim 12, wherein the handgrip is a hollow shaft and a top opening for the weighted cylinders removably inserted in the handgrip.

14. The apparatus of claim 12, wherein the handgrip is a hollow shaft and a bottom opening to admit a top of a ski pole inserted in the handgrip with a tight friction fit.

15. The apparatus of claim 5 further comprises a supplementary battery powered by the generator means to supply power to the lights during rest periods.

* * * * *